United States Patent [19]

Yamamoto et al.

[11] Patent Number: 4,492,213

[45] Date of Patent: Jan. 8, 1985

[54] IGNITION SYSTEM FOR INTERNAL COMBUSTION ENGINES

[75] Inventors: Noboru Yamamoto; Ryoichi Okuda, both of Kariya; Tomoatsu Makino, Okazaki, all of Japan

[73] Assignee: Nippondenso Co., Ltd., Kariya, Japan

[21] Appl. No.: 577,316

[22] Filed: Feb. 6, 1984

Related U.S. Application Data

[63] Continuation of Ser. No. 327,114, Dec. 3, 1981, abandoned.

[30] Foreign Application Priority Data

Dec. 8, 1980 [JP] Japan ..... 55-172790

[51] Int. Cl.[3] ..... F02P 1/00

[52] U.S. Cl. ..... 123/644; 123/623

[58] Field of Search ..... 123/623, 644

[56] References Cited

U.S. PATENT DOCUMENTS

| | | | |
|---|---|---|---|
| 3,605,713 | 9/1971 | Masters | 123/644 |
| 3,882,840 | 5/1975 | Adamian | 123/644 |
| 3,938,490 | 2/1976 | Snyder | 123/644 |
| 4,008,698 | 2/1977 | Gartner | 123/644 |
| 4,147,145 | 4/1979 | Domland | 123/644 |
| 4,153,032 | 5/1979 | Chateau | 123/644 |
| 4,308,848 | 1/1982 | Pfaff | 123/644 |
| 4,327,310 | 4/1982 | Jorg | 123/644 |

FOREIGN PATENT DOCUMENTS

| | | | |
|---|---|---|---|
| 53-57129 | 5/1978 | Japan | 123/644 |

*Primary Examiner*—Ronald B. Cox

*Attorney, Agent, or Firm*—Cushman, Darby & Cushman

[57] ABSTRACT

An improved ignition system for internal combustion engines including a constant current control circuit for effecting constant current control of an ignition coil primary current, further includes a compensating circuit for controlling a reference voltage, which is to be compared with a detection value of the ignition coil primary current, at a constant value irrespective of a decrease of a power supply voltage, thereby controlling the ignition coil primary current at a given value over a wide range of variations of the power supply voltage including a considerable decrease thereof.

1 Claim, 3 Drawing Figures

IGNITION SYSTEM FOR INTERNAL COMBUSTION ENGINES

This is a continuation of application Ser. No. 327,114, filed Dec. 3, 1981 now abandoned.

FIELD OF THE INVENTION

This invention relates to an ignition system for internal combustion engines, especially, automotive internal combustion engines, and more particularly, this invention relates to improvements in a control system for controlling an ignition coil primary current in the ignition system at a predetermined constant value.

DESCRIPTION OF THE PRIOR ART

Japanese Utility Model Application No. 51-138804 [Utility Model Application Kokai (Laid-open) No.53-57129] discloses an ignition system comprising a reference voltage generating circuit in the electric circuitry thereof and comparing a reference voltage from the reference voltage generating circuit with a detection value of an ignition coil primary current thereby to limit the magnitude of the primary current flowing through the ignition coil, wherein when the power supply voltage decreases, the reference voltage is increased to raise the magnitude of the limited primary current.

In the system disclosed by Japanese Utility Model Application No. 51-138804, as the power supply voltage decreases, the reference voltage is increased to increase the limitation value of the ignition coil primary current. With an ignition system having a construction of the above-mentioned type, however, the current limit value of the primary current of the ignition coil is increased as the power supply voltage decreases, which necessarily increases an interrupting current flowing through a power transistor for switching on and off the primary current in the ignition coil, thereby making it necessary to employ a power transistor having a greater current capacity. Thus, there is a disadvantage of increasing the cost of an ignition system.

Figure 1:
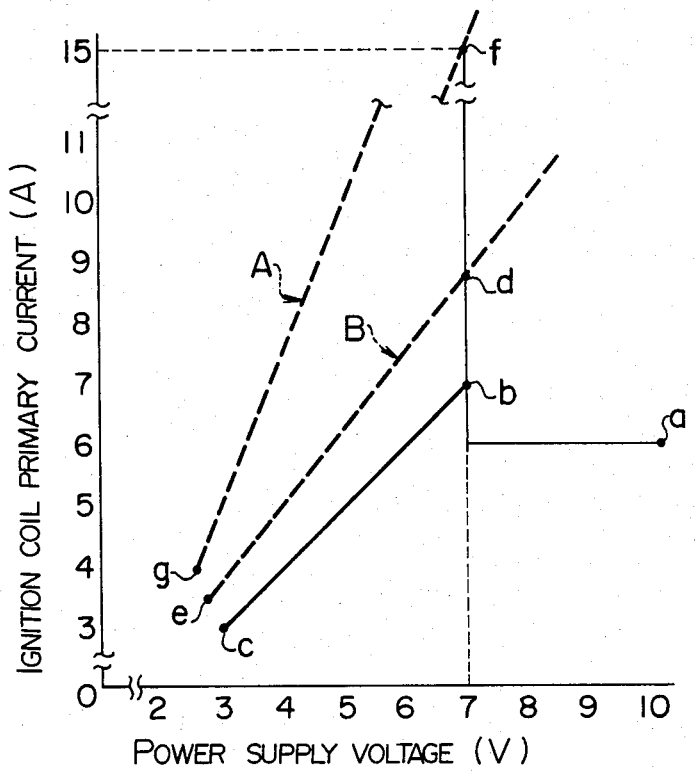
FIG. 1 is a characteristic diagram showing a state in which the ignition coil primary current in a prior art ignition system varies with variations of the power supply voltage.

FIG. 1 shows, by way of an example, a state in which the ignition coil primary current varies with variations of the power supply voltage in a prior art ignition system. A broken line A shows a state in which the current flowing through the primary winding of the ignition coil with no limitation placed on its magnitude varies when the primary resistance of the ignition coil is 0.4Ω. A broken line B shows a similar state but when the ignition coil primary resistance is 0.8 Ω. Here, it is assumed that the reference voltage is increased when the power supply voltage is lower than 7 V, for example. While the current limit value varies with an increase of the reference voltage, if the reference voltage is increased to its full extent, that is, if the current limitation is cancelled, the ignition coil primary current varies along a line a-f-g when the primary coil resistance is 0.4 Ω, and the primary current varies along a line a-d-e when the primary coil resistance is 0.8 Ω. As will be seen from FIG. 1, the primary current increases when the power supply voltage becomes 7 V where the reference voltage is to be raised, and in particular the primary current becomes extremely great when the ignition coil primary resistance is small. In an attempt to prevent such an extreme increase in the primary current, if the increase of the primary current is limited to an excess of 1 A over a given current limit value, then the limited current varies along a line a-b-c when the coil resistance is 0.4 Ω and 0.8 Ω, respectively. The reason is that when the power supply voltage decreases from 7 V downward, the reference voltage also decreases with a decrease of the power supply voltage, and if the power supply voltage drops below 6 V, the primary current becomes lower than the current limit value of 6 A to be reached when the power supply voltage exceeds 7 V. Thus, there is a disadvantage such that even when the power supply voltage has decreased but still remains high enough to provide the proper limited current (6 A in the above-mentioned case), the ignition coil primary current is subjected to limitation caused by the circuitry of the system, and the primary current is limited to a value lower than the proper current limit value.

The present invention has been made with the intention of overcoming the above-mentioned deficiency of the prior art systems.

SUMMARY OF THE INVENTION

It is a general object of this invention to provide an ignition system for internal combustion engines comprising a constant current control circuit for effecting constant current control of a current flowing through the primary winding of the ignition coil, which ignition system further comprises a compensating circuit for controlling a reference voltage, which is compared with a detection value of the current flowing through the ignition coil primary winding, at a predetermined voltage value in response to a decrease of a power supply voltage, thereby limiting the ignition coil primary current to a given constant value even if the power supply voltage decreases.

DESCRIPTION OF THE PREFERRED EMBODIMENT

Figure 2:
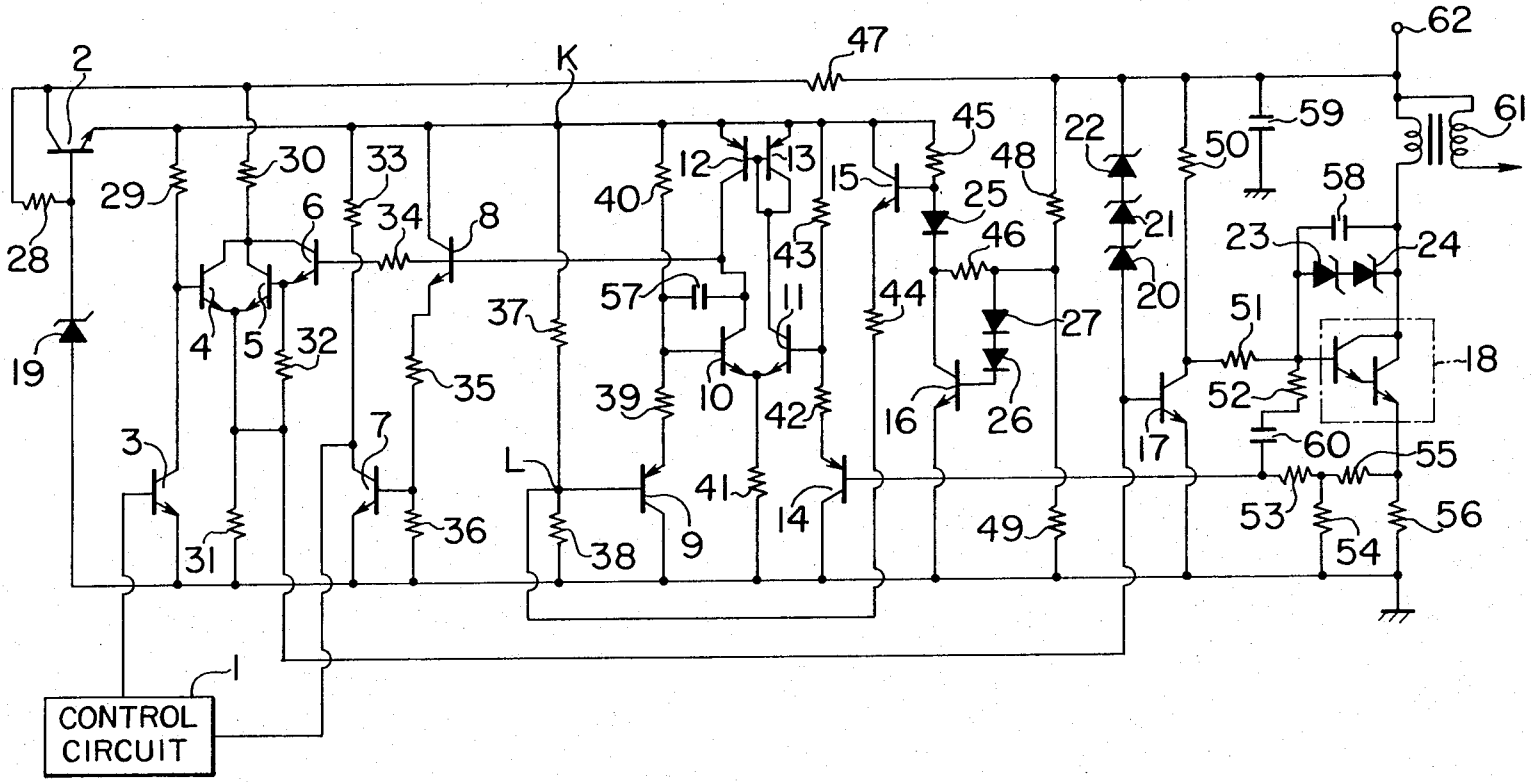
FIG. 2 is a circuit diagram of an ignition system according to an embodiment of the invention.

A preferred embodiment of this invention will be described with reference to the accompanying drawings. FIG. 2 shows electric circuitry of an ignition system according to an embodiment of this invention. In FIG. 2, numeral 1 designates a control circuit of the type known in the prior art which outputs a control signal for controlling the interruption of an ignition coil primary current in synchronism with the rotation of an engine and which also modifies a duty cycle of the control signal so as to shorten a constant current control time as far as possible in accordance with a time length during which the constant current control of the ignition coil primary current is effected. Numerals 2 to 16 designate transistors, 18 a power transistor circuit for controlling the ignition coil primary current, 17 a transistor for driving the power transistor circuit 18, 19 a Zener diode for constant voltage supply, 20 to 22 overvoltage protecting Zener diodes, 23 and 24 protective Zener diodes for the power transistor circuit 18, 25 to 27 diodes, 28 to 56 resistors, 57 an oscillation preventive capacitor, 58 to 60 capacitors, 61 an ignition coil, and 62 a power supply terminal.

The operation of the electric circuitry of the ignition system when the power supply voltage varies as shown in FIG. 2 will now be described.

Driven by the control signal having a rectangular shape generated by the control circuit 1, the transistor 3 effects a switching operation and controls the power transistor circuit 18 by way of the transistors 4 and 17 and the resistor 51. While the transistor 3 is turned off, the transistor 4 is turned on and consequently the transistor 17 is turned on, thereby turning off the power transistor circuit 18. Thus, no current flows through the primary winding of the ignition coil 61. Then, when the transistor 3 is turned on, the transistor 4 is turned off and consequently the transistor 17 is turned off. Then, the power transistor circuit 18 is turned on and a current flows through the primary winding of the ignition coil 61. This current is detected by the resistor 56. The detection voltage is divided by the resistors 55 and 54, and the divided voltage is sent to a comparison circuit via the resistor 53. In the comparison circuit including the transistors 9 to 14, one of input voltages thereto, namely, the divided detection voltage, is compared with the other input voltage, namely, a reference voltage determined by the voltage division by the resistors 37 and 38. When the primary current of the ignition coil 61 increases, the former input voltage to the comparison circuit, namely, a base voltage of the transistor 14 increases, and when it exceeds a base potential of the transistor 9 which is given by the latter input voltage or the reference voltage, the transistor 11 conducts more heavily and the transistor 10 is rendered less conductive to cause its collector potential to rise. As a result, the transistors 6 and 5 become more conductive, which causes a greater base current to flow into a base of the transistor 17 via the resistor 30 and the transistor 5, so that the transistor 17 is rendered more conductive causing its collector potential to decrease. As a result, a base current of the power transistor circuit 18 decreases to limit the primary current of the ignition coil 61 to a predetermined value. Further, when the collector potential of the transistor 10 rises while the constant current control is effected, the transistor 8 is turned on and consequently the transistor 7 is also turned on. Thus, a high level input control signal applied to the control circuit 1 is reduced to zero potential. This input control signal is used to modify the duty cycle of the output signal having a rectangular waveform from the control circuit 1 so as to decrease, as far as possible, the time length during which the constant current control is effected.

Next, the operation of the electric circuitry of the ignition system of this invention will be described with reference to a case where the power supply voltage decreases. When the power supply voltage decreases at the time of the start of the engine and so on so that the power supply voltage at the terminal 62 minus a voltage drop across the resistor 47 becomes lower than a Zener voltage of the Zener diode 19, the Zener diode 19 is turned off and the voltage at a point K on a constant voltage supply line can no longer remain constant but decreases as the power supply voltage decreases. The electric circuitry of the ignition system of the present invention is provided with a compensating circuit which comprises the resistors 44, 45, 46, 48 and 49, the transistors 15 and 16 and the diodes 25, 26 and 27 and makes the reference voltage at a point L remain constant, even if the voltage at the point K decreases as the power supply voltage de- creases.

The operation of the compensating circuit will now be described. Firstly, when the power supply voltage is high, the transistor 16 is supplied via the resistor 48 and the diodes 27 and 26 with a base current having a sufficient magnitude to render its collector current saturated. As a result, the collector potential of the transistor 16 is reduced substantially to zero potential and hence the transistor 15 is turned off. Thus, the reference voltage at the point L takes a constant value determined by the constant voltage of the constant power supply at the point K and the values of the voltage dividing resistors 37 and 38. By virtue of the operation just described the reference voltage is maintained at the constant value over a range of the power supply voltage where the voltage at the point K can be maintained at the constant value. Then, as the power supply voltage decreases so that the voltage at the point K can no longer be maintained at the constant voltage, the base current of the transistor 16 decreases as the power supply voltage decreases and the collector potential of the transistor 16 increases substantially in inverse proportion to the decrease of the power supply voltage. As a result, the emitter potential of the transistor 15 also rises in inverse proportion to the decrease of the power supply voltage, so that the value of the reference voltage at the point L is maintained constant even if the power supply voltage decreases. By virtue of the above-mentioned operation, even when the power supply voltage decreases and thereby the voltage of the constant power supply can no longer be maintained constant, the value of the reference voltage at the point L is maintained constant and hence the ignition coil primary current can be limited to the constant value.

Figure 3:
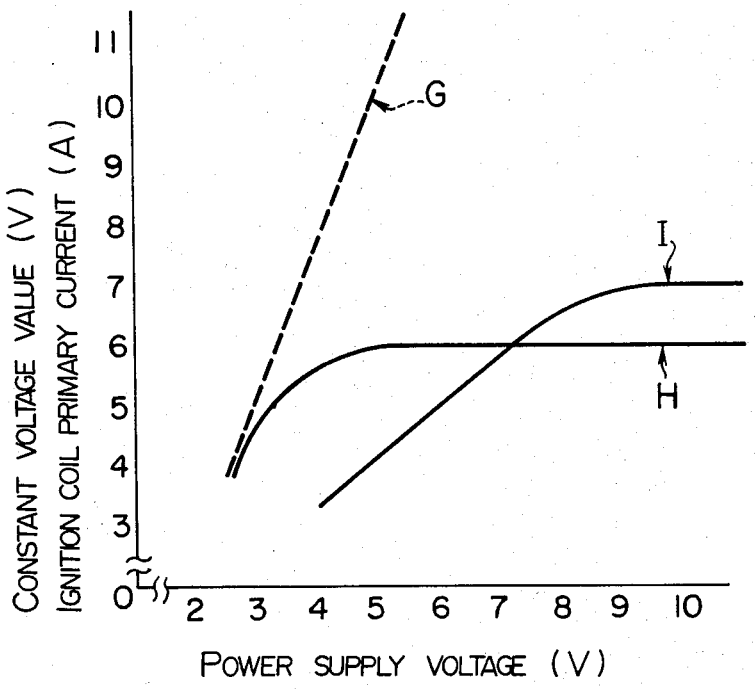
FIG. 3 is a characteristic diagram showing the state in which the ignition coil primary current varies with variations of the power supply voltage in the ignition system according to the embodiment of the invention.

FIG. 3 shows an operating characteristic of the electric circuitry of the ignition system according to the embodiment of this invention when the power supply voltage varies.

A broken line G shows the ignition coil primary current when no limitation is placed thereon. A solid line H shows the primary current of the ignition coil which is controlled by the electric circuitry of this invention. The controlled primary current shown by the solid line H is controlled at a given constant value over a broad range of variations of the power supply voltage and until it decreases considerably. A solid line I shows the voltage on the constant voltage supply line in the electric circuitry of this invention (in other words, the voltage at the point K in FIG. 2) which varies as the power supply voltage varies.

The present invention brings an excellent advantage such that, even when the power supply voltage decreases at the time of the start of the engine, the compensating circuit operates in response to the decrease of the power supply voltage to control so that the value of the reference voltage to be compared with a voltage representing the ignition coil primary current may be maintained constant, thereby making it possible to limit the ignition coil primary current to a constant value, even if the power supply voltage decreases. As a result, there is a remarkable attendant advantage such that, since the ignition coil primary current does not increase greatly, there is no need to use a power transistor having a large current capacity, which makes it possible to reduce the manufacturing cost of the system.

We claim:

1. An ignition system for internal combustion engines for effecting constant current control of an ignition coil primary current comprising:

an ignition coil;

an adjusting circuit for adjusting a magnitude of an interrupted primary current of said ignition coil;

a circuit for detecting the magnitude of the interrupted primary current of said ignition coil and generating a primary current detection signal;

a constant voltage circuit connected to a power supply and regulating a power supply voltage from said power supply to supply a constant output voltage;

a circuit for generating a reference voltage from an output voltage of said constant voltage circuit, wherein said reference voltage generating circuit includes a voltage dividing circuit connected to an output of said constant voltage circuit;

a comparison circuit for comparing a voltage of said primary current detection signal with said reference voltage and supplying an output signal as an adjusting signal of said adjusting circuit;

a circuit for detecting a decrease of said power supply voltage below a voltage regulation threshold input level of said constant voltage circuit; and a compensating circuit responsive to a detection output of said power supply voltage decrease detecting circuit to increase said reference voltage substantially in proportion to the decrease of said power supply voltage below the voltage regulation threshold input level of said constant voltage circuit, and wherein said compensating circuit comprises a transistor circuit having a collector-emitter circuit connected in series between the output of said constant voltage circuit and a voltage dividing point of said voltage dividing circuit, and a base voltage adjusting circuit responsive to the detection output of said power supply voltage decrease detecting circuit to vary a base voltage of a transistor comprised in said transistor circuit so as to increase conduction through said transistor circuit in proportion to the decrease of said power supply voltage, whereby the magnitude of the interrupted primary current of said ignition coil is controlled at a given constant value irrespective of the decrease of said power supply voltage to a level lower than the voltage regulation threshold input level of said constant voltage circuit.

* * * * *